US006113099A

United States Patent [19]

Moessmer

[11] Patent Number: 6,113,099

[45] Date of Patent: Sep. 5, 2000

[54] RANDOM NUMBER DISPENSER

[76] Inventor: Raimund Moessmer, Kraxnbichlweg 3, D-82544 Neufahrn/Egling, Germany

[21] Appl. No.: 09/091,577

[22] PCT Filed: Dec. 18, 1996

[86] PCT No.: PCT/EP96/05687

§ 371 Date: Jan. 13, 1999

§ 102(e) Date: Jan. 13, 1999

[87] PCT Pub. No.: WO97/23847

PCT Pub. Date: Jul. 3, 1997

[30] Foreign Application Priority Data

Dec. 21, 1995 [DE] Germany ..... 195 48 034

[51] Int. Cl.[7] ..... A63F 3/06

[52] U.S. Cl. ..... 273/144 B; 273/144 R

[58] Field of Search ..... 273/144 A, 144 B, 273/144 R, 145 C

[56] References Cited

U.S. PATENT DOCUMENTS 5,454,567 10/1995 Adell ..... 273/144 B

FOREIGN PATENT DOCUMENTS

| | | | |
|---|---|---|---|
| 392496 | 10/1990 | European Pat. Off. | 273/144 B |
| 2255926 | 5/1974 | Germany | 273/144 B |
| 8606745 | 7/1987 | Germany | 273/144 B |
| 3614822 | 11/1987 | Germany | 273/144 B |
| 509562 | 7/1939 | United Kingdom | 273/144 B |

*Primary Examiner*—Benjamin H. Layno

*Attorney, Agent, or Firm*—Reed Smith Shaw & McClay LLP

[57] ABSTRACT

A random number generator is disclosed for selecting a limited number quantity from a predetermined number quantity, having a casing with a space for receiving the number bodies and a display or indication area adjacent thereto and connected to the space, said space being at least partly constructed with rounded marginal areas and the display area is connected to one side of the space. The number bodies have a peak-to-valley height of approximately 0.002 mm to 0.009 mm.

13 Claims, 4 Drawing Sheets

RANDOM NUMBER DISPENSER

BACKGROUND OF THE INVENTION a) Field of the Invention

The invention relates to a random number generator for selecting a limited number quantity from a predetermined number quantity and having a casing with a space for receiving number bodies and a display area adjacent thereto and connected to the space.

b) Description of the Related Art

Random number generators of this type are used for assisting the choice of numbers to be marked off in number games of chance, such as e.g. Lotto or Toto. Such a mechanical random number generator is described in EP 90 106 936.9. The known random number generator comprises a casing with a space for receiving number bodies and a display area adjacent thereto and connected to the space, the latter being constructed with rounded marginal areas and the display area in the form of an elongated rectangle is connected by its longitudinal side to one side of the space. The number bodies used and which are in each case provided with a number or numerical sequence, are in each case small, circular disk or plates, which are mixed in the space or in the mixing space or in the drum of the random number generator by a corresponding mixing movement of the generator.

In order to make a draw, through a corresponding movement the number body or plates are allowed to fall into the display area, so that in this way the drawn random numbers can be read off. Even if the mixing space and display area are geometrically designed in such a way that, as in the prior art, a bridge formation of bridging with several plates and therefore a mutual restraint of the number bodies with respect to one another is prevented, so as to arrive at a clear draw result, e.g. in the mixing space such undesired bridge formations can arise. The free movement of one or other number body can consequently be prevented.

OBJECT AND SUMMARY OF THE INVENTION

The primary object of the present invention is consequently to so further develop a random number generator of the aforementioned type, that bridge formations or bridgings are substantially avoided.

This object is achieved in that the number bodies have a peak-to-valley height of approximately 0.002 to 0.009 mm.

Thus, on their surface, the number bodies have an average peak-to-valley height of approximately 0.002 to 0.009 mm. Thus, it has been found that the peak-to-valley height has a significant influence on bridging or the avoidance of bridging of number bodies in the mixing space. If the peak-to-valley height is excessive, i.e. exceeds approximately 0.009 mm, this can lead to a restricted mobility of one or other number body in the mixing space or in the random number generator casing, which favors bridging. An increased bridging rate also arises, if the peak-to-valley height is below approximately 0.002 mm. In this range, the mobility of the number bodies in the random number generator casing is so high that during a draw, e.g. a relatively large number of number bodies can simultaneously arrive in the display or indicating area, so that once again bridge formations can arise. In the peak-to-valley height range between approximately 0.002 and 0.009 mm according to the present invention, there is a clearly reduced tendency to bridge formation. From the manufacturing standpoint, a range between approximately 0.004 and 0.007 mm is preferred for the average peak-to-valley height.

Preferably the number bodies are made from an antistatic material, which largely prevents an electrostatic charging of the number bodies or the casing, which is particularly significant, if the casing and number bodies are made from plastic. If the number bodies were made from a statically chargeable material, where the electrostatic charge could e.g. be caused by the friction of the number bodies against one another or of the number bodies with the random number generator casing wall, this could lead to mutual restraints of the number bodies due to electrostatic charging, which would favor bridge formations. Through the use of antistatic material or material with only a limited electrostatic chargeability, said bridging can be avoided. Probably the aforementioned peak-to-valley height range for the number body surface also plays a part in reducing the effects of electrostatic charging of the number bodies.

Preferably, the random number generator casing is made from a flexible, elastic plastics material, which allows bending to a certain extent without any permanent deformation or damage, such as is e.g. the case with a normal credit or chip card. Through the use of an elastic plastic, handling of the random number generator is improved.

The random number generator casing can comprise several parts, which are ultrasonically welded together to form the casing. The use of ultrasonic welding for joining the individual casing parts gives a stable and durable casing, particularly when using casing parts made from an elastic plastics material. The individual casing parts can be made from transparent plastic (e.g. polycarbonate, PC), which can be printed e.g. by offset printing.

At least with respect to the exterior, the average peak-to-valley height of the casing parts can be in a range between approximately 0.002 mm and 0.009 mm. Preferably the peak-to-valley height is approximately 0.003 mm, in order to achieve optimum printability of the outer surfaces of the casing, particularly the cover.

The specific peak-to-valley height of the disk surface and the surfaces of the casing part can e.g. be achieved in planned manner by lapping or grinding the surfaces or similar surface treatments.

The random number generator casing can have spacers or supports, which ensure that the internal diameter of the mixing space or drum is maintained. This is of particular significance if the user holds in the hand a random number generator of credit card format and when pressure is exerted on the casing which, without spacers, would lead to the compression of the casing walls and the jamming or impediment of movement of the intermediate number bodies.

According to a preferred embodiment, the random number generator comprises a base and a cover, which are made from transparent, injection molded plastics parts and are interconnected by ultrasonic welding, in order to form a closed random number generator casing.

The random number generator according to the invention or the casing thereof can, for easy handling and space-saving housing, have a credit card format of approximately 85 mm×54 mm×1.6 mm.

Suitable plastics materials for the casing parts and disks are e.g. polycarbonate (PC) (transparent, high strength, good toughness, low electrostatic charging), styrene-acrylonitrile copolymer (SAN) (similar characteristics to PG), polypropylene (PP) or a polyacrylate (PMMA).

Further advantages and use possibilities of the present invention can be gathered from the following description of an embodiment of the invention in conjunction with the attached drawings.

DESCRIPTION OF THE PREFERRED EMBODIMENTS

Figure 3:
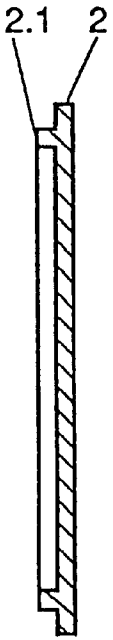
FIG. 3 shows a cover part of the casing which, together with the base part according to FIG. 1, forms the casing of the random number generator according to the embodiment.

According to a first embodiment (FIGS. 1 to 3) of the present invention, the random number generator comprises a lower part 12, a frame 11 (central part), which together form a base, and an upper part 2 (cover). The frame 11 has a substantially rectangular contour with rounded corners and essentially comprises an outer, closed, all-round frame shoulder 11.1 and an inner, closed, all-round frame shoulder 11.2, which forms and bounds the inner contour of the space 3 or mixing space. Between the outer frame shoulder 11.1 and the inner frame shoulder 11.2 extends a frame depression 11.3.

Along a longitudinal side of the space 3 passes an indication or display area 5, which is connected to the space 3 and has six bulges 5.1, 5.2, 5.3, 5.4, 5.5 and 5.6. The transition from space 3 into display area 5 is given by two conically tapering flanks of the inner contour or the inside of the inner frame shoulder 11.2.

The lower part 12 is designed as a substantially rectangular disk, on which is located the underside of the frame 11. The upper part 2 essentially comprises a rectangular disk, which has an all-round shoulder or tongue 2.1. In the installed state of the casing, 1, 2 of the random number generator, the shoulder 2.1 of the upper part 2 engages in the frame depression 11.3 in accordance with the tongue and groove principle.

From the lower part 12, three spaced spacers 6 project into the random number generator space 3. In the installed state of the casing 1, 2, said spacers 6 ensure the internal diameter or clearance (e.g. 0.6 mm) of the space 3 between the lower part 12 and upper part 2.

Figure 1:
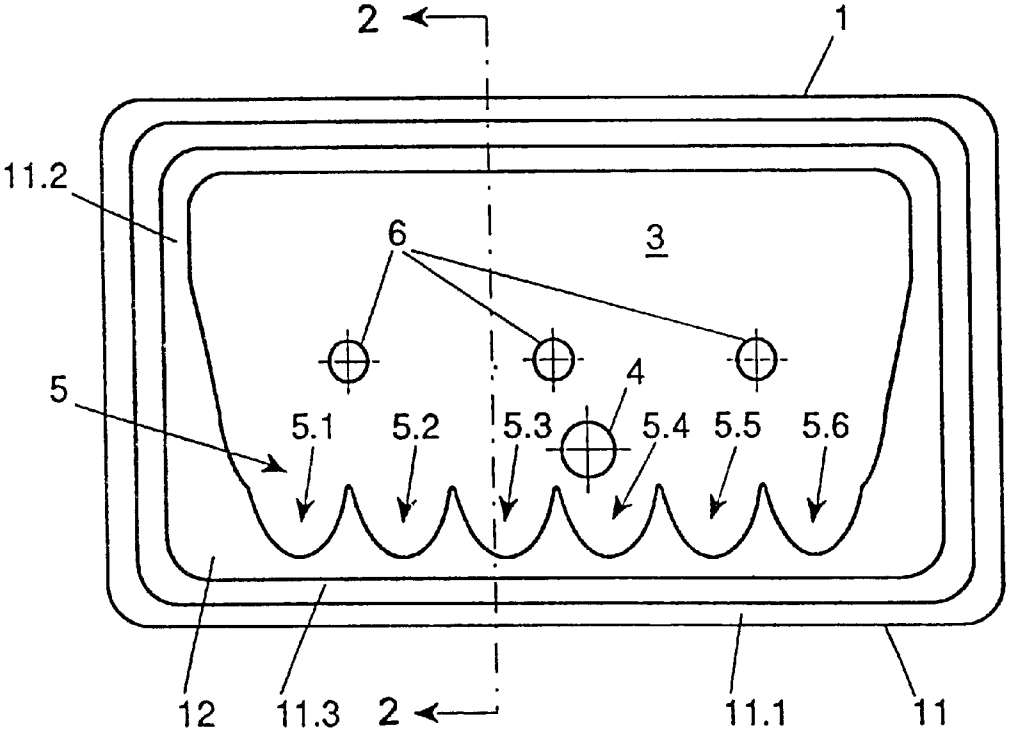
FIG. 1 illustrates a base part of the casing of the random number generator according to a first embodiment of the invention in plan view, with an exemplified number bodies having a circular disk shape.

FIG. 1 shows in exemplified manner a circular number body 4 in space 3. The casing 1, 2 of the installed random number generator houses 49 number bodies 4, which are in each case provided with a number between 1 and 49. The number bodies 4 are made from plastic and are punched by means of a punch from a plastic plate or cut to length from a rod. The surface of the number bodies 4 has a peak-to-valley height in the range between approximately 0.004 mm and 0.007 mm, which is achieved e.g. by lapping the surfaces of the number bodies. This prevents bridge formations or bridging of the multi-number number bodies in the casing 1, 2. In addition, the number body material is substantially antistatic. The number bodies have in each case a diameter of approximately 4 mm and a thickness between preferably approximately 0.4 mm and 0.6 mm. Finally, a number is printed on each of the number bodies.

Figure 4:
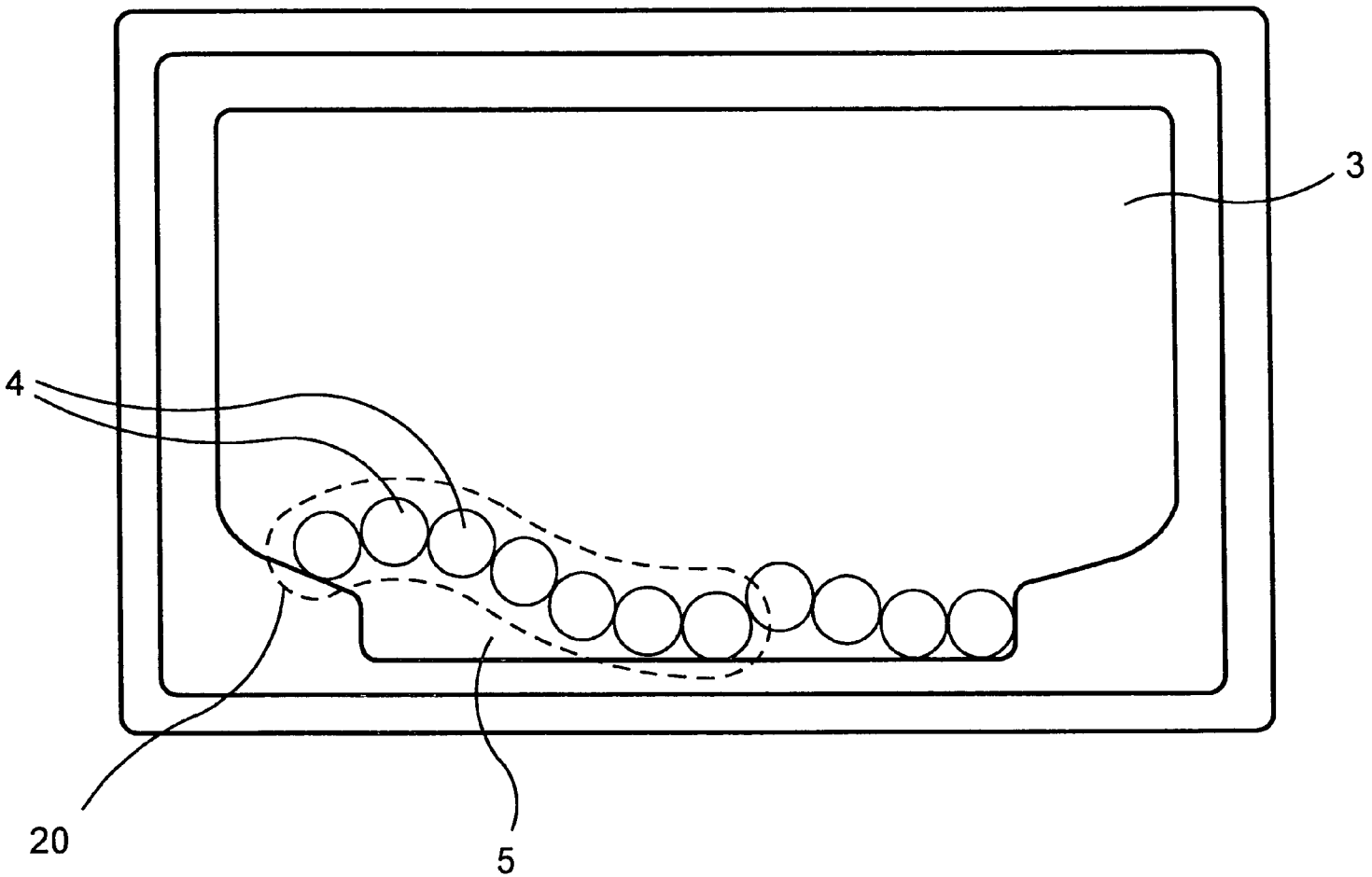
FIG. 4 illustrates the formation of a bridge in a random number generator.
Figure 5:
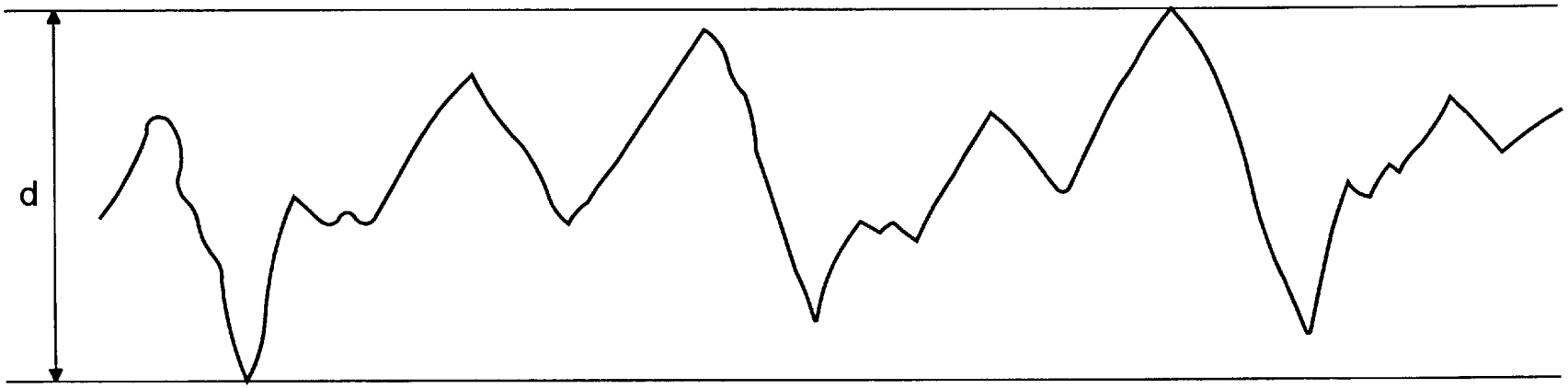
FIG. 5 schematically illustrates the peak-to-valley height of the surface of a body.
Figure 6B:
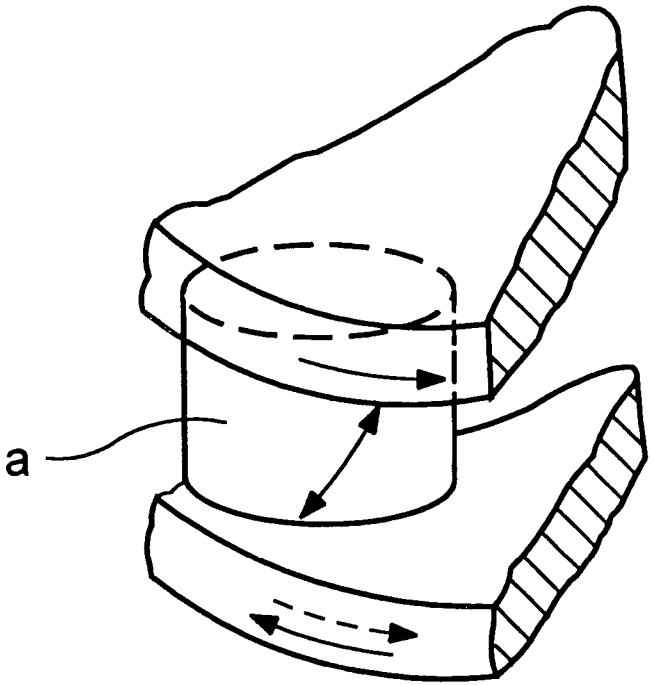
FIGS. 6*a* and 6*b* schematically illustrate how a surface can be lapped.
Figure 6A:
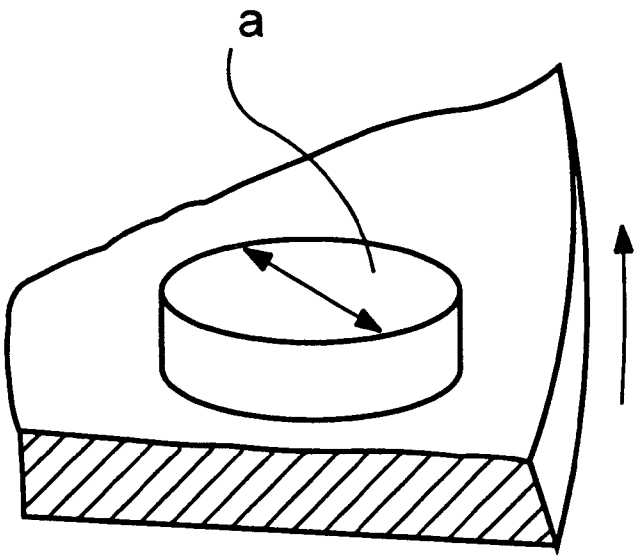

As shown in the random number generator in FIG. 4, the above-mentioned bridge is represented by reference number 20 and may be formed in prior art devices, leaving a vacant space below it. FIG. 5 is an enlarged scale of the surface of a body, wherein "d" represents the peak-to-valley height of the surface of a body. Namely, distance "d" is the distance from the highest peak to the deepest valley of the surface of the body. FIGS. 6*a* and 6*b* schematically illustrate how a surface can be lapped, which is well know in the art. As known, a work piece "a" and one or more tools slide over each other in the directions shown, to obtain the above-mentioned desired peak-to-valley height.

Figure 2:
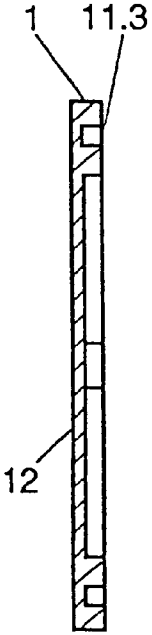
FIG. 2 A section through the base part of fig; along line II—II in FIG. 1.

The random number generator according to FIGS. 1 to 3 is produced as follows. The lower part 12 and frame 11 are together produced as a one-piece injection molding 1 (base) by injection moulding from transparent plastic. In the same way, the upper part 2 or cover is produced by injection molding from the same transparent plastic (e.g. styrene-acrylonitrile copolymer—SAN). In the space 3 of the injection molding 1 are then placed the finished number bodies 4, printed with corresponding numbers and made from plastic (e.g. acrylonitrile-butadiene-styrene polymer—ABS—with a very low electrostatic chargeability). On the top of the frame 11 is then placed the upper part 2, whose shoulder 2.1 engages in the frame depression 11.3 of the injection molding 1, in order to orient the parts with one another. The thus combined parts 1 and 2 are then ultrasonically welded in all-round manner in the frame area in order to form the closed casing 1, 2 of the random number generator. In order to bring about optimum printability, then e.g. the outer surface of the cover is worked e.g. by lapping, so as to obtain an average peak-to-valley height of approximately 0.003 mm or 3.0 mm.

According to another, second embodiment of the invention, the random number generator casing is made from three parts, namely a lower part, a central part and an upper part. Unlike in the first embodiment according to FIGS. 1 to 3, the lower and upper parts are constituted solely by rectangular disks, e.g. of transparent plastic. The central part comprises a through frame which, apart from the missing depression, is similar to the frame 11 of FIG. 1 and has an underside and a top side.

In the second embodiment, firstly the lower part 12, which is identical to the disk-shaped upper part, is punched from a transparent plastic plate. The central part, i.e. the frame, is also punched from a transparent plastics material.

On assembling the casing of the second embodiment, firstly the lower part is placed on the underside of the central part and is welded to the frame using an ultrasonic welding apparatus. After fixing spacers, e.g. by bonding, to the lower part, the number bodies 4 are inserted in the resulting partial casing. The upper part is then congruently placed on the top of the frame and in the marginal area or frame area is welded to the frame, so as to produce a closed casing 1, 2 for the random number generator.

The casing 1, 2 of the aforementioned embodiments has a credit card format, namely approximately 85 mm×54 mm×1.6 to approximately 2.6 mm. The casing can be offset printed outside the display or indication area 5. Through the use of transparent plastic, the numbers of the six number bodies 4 located in the bulges 5.1 to 5.6 can be readily read off following a draw. Unlike in the aforementioned embodiments, the display area 5 can be constructed as a continuous, rectangular area without any bulges.

While the foregoing description and drawings represent the present invention, it will be obvious to those skilled in the art that various changes may be made therein without departing from the true spirit and scope of the present invention.

What is claimed is:

1. A random number generator for selecting a limited number quantity from a predetermined number quantity comprising:

a casing with a space for receiving disk-shaped number bodies; and a display area adjacent thereto and connected to the space;

said space being at least partly constructed with rounded marginal areas;

said display area being connected to one side of the space;

said number bodies having a peak-to-valley height between approximately 0.002 mm and 0.009 mm, said number bodies being antistatic.

2. The random number generator according to claim 1, wherein each of the number bodies has the shape of a circular disk.

3. The random number generator according to claim 1, wherein the number bodies are made from plastic.

4. The random number generator according to claim 1, wherein the casing of the random number generator is made from a flexible and/or elastic plastic.

5. The random number generator according to claim 1, wherein said casing includes a) a central part, which has a frame, whose inner contour bounds the space for receiving the number bodies and the adjacent display area of the random number generator and which has an underside and a top side;

b) a disk-shaped upper part, which is placed on the top of the frame; and c) a disk-shaped lower part, which is placed on the underside of the frame.

6. The random number generator according to claim 5, wherein the lower part and the central part are constructed as a one-piece injection molding and the upper part is constructed as a one-piece injection molding, which are ultrasonically welded together in order to form the closed casing of the random number generator.

7. The random number generator according to claim 5, wherein the upper part and/or lower part have spacers, which project into the space, in order to ensure the internal diameter of the space between the upper part and the lower part.

8. The random number generator according to claim 1, wherein the casing is at least partly made from transparent plastic.

9. The random number generator according to claim 5, wherein the upper part and lower part are ultrasonically welded to the central part in order to form a closed casing.

10. The random number generator according to claim 1, wherein the random number generator has the dimensions of a credit card of approximately 85 mm×54×1.6 mm.

11. The random number generator according to claim 1, wherein the outer surface of the casing has at least partly a peak-to-valley height in the range between approximately 0.002 mm and 0.009 mm.

12. The random number generator according to claim 11 wherein the outer surface of the casing has at least partly a peak-to-valley height of approximately 0.003 mm.

13. The random number generator according to claim 1, wherein the peak-to-valley height of the surface of the number bodies is in the range between approximately 0.004 mm and 0.007 mm.

* * * * *